US006250363B1

(12) United States Patent
Doutre et al.

(10) Patent No.: US 6,250,363 B1
(45) Date of Patent: Jun. 26, 2001

(54) RAPID INDUCTION MELTING OF METAL-MATRIX COMPOSITE MATERIALS

(75) Inventors: Don Doutre, Kingston; Gary Hay, Ontario; Peter Wales, Kingston, all of (CA); Richard S. Bruski, Northville, MI (US)

(73) Assignee: Alcan International Ltd., Monreal (CA)

( * ) Notice: Subject to any disclaimer, the term of this patent is extended or adjusted under 35 U.S.C. 154(b) by 0 days.

(21) Appl. No.: 09/131,139

(22) Filed: Aug. 7, 1998

(51) Int. Cl.[7] ..... B22D 19/14; B22D 23/06; B22D 27/02

(52) U.S. Cl. ..... 164/97; 164/80; 164/493

(58) Field of Search ..... 164/97, 94, 80, 164/113, 492, 493

(56) References Cited

U.S. PATENT DOCUMENTS

| | | | | |
|---|---|---|---|---|
| 4,231,796 | | 11/1980 | Clark et al. | 75/206 |
| 4,569,218 | | 2/1986 | Baker et al. | 72/342 |
| 4,694,881 | | 9/1987 | Busk | 164/113 |
| 4,842,038 | | 6/1989 | Fujino et al. | 164/80 |
| 5,040,589 | | 8/1991 | Bradley et al. | 164/113 |
| 5,246,057 | * | 9/1993 | Hansson et al. | 164/97 |
| 5,577,546 | * | 11/1996 | Kijar et al. | 164/97 |

FOREIGN PATENT DOCUMENTS

| | | | |
|---|---|---|---|
| 0 387 107 | | 9/1990 | (EP) . |
| 0583124A | * | 2/1994 | (EP) . |
| 0 583 124A | | 2/1994 | (EP) . |
| 3-199318 | | 8/1991 | (JP) . |
| 3-199326 | | 8/1991 | (JP) . |
| 6-322471 | | 11/1994 | (JP) . |
| WO 92 15412A | | 9/1992 | (WO) . |
| WO 97/21509 | | 6/1997 | (WO) . |

OTHER PUBLICATIONS

Enright et al., "Rapid Induction Melting of Discrete Volumes of MMC An Economic Altenative to Bulk Metal Handling," ISATA, Sep. 13–17, 1993, pp. 545–551.*

Richards, "RIMLOC—A Single Shot Casting Technique for the Future", Aluminum Today, Dec. 1996/Jan. 1997, pp. 33, 34, 37.*

Enright et al., "Rapid Induction Melting of Discrete Volumes of MMC, An Economic Alternative to Bulk Metal Handling," 26th International Symposium on Automotive Technology and Automation, Sep. 13–17, 1993, pp. 545–551.

Richards, "RIMLOC—A single shot casting technique for the future", *Aluminum Today,* Dec. 1996/Jan. 1997, pp. 33,34.37.

* cited by examiner

*Primary Examiner*—Kuang Y. Lin
*Assistant Examiner*—I. -H. Lin
(74) *Attorney, Agent, or Firm*—Gregory Garmong

(57) ABSTRACT

A composite material is rapidly melted by furnishing a pre-wetted composite material in the form of granules, placing the granules into an induction coil, and powering the induction heater to melt the metal matrix portion of the granules to form a molten mixture. High power inputs to the induction coil may be used, so that the granules are rapidly heated to their melting point and to temperatures above the melting point, from which the molten mixture may be cast. Because of the rapid heating, otherwise-reactive composite materials may be prepared by melting in air.

20 Claims, 3 Drawing Sheets

RAPID INDUCTION MELTING OF METAL-MATRIX COMPOSITE MATERIALS

BACKGROUND OF THE INVENTION

This invention relates to metal-matrix composite materials, and, more particularly, to the fabrication of articles from such materials by melting and casting.

In one form of a metal-matrix composite material, a reinforcement phase is embedded in a metal matrix. The reinforcement is typically equiaxed or elongated particles of a ceramic phase such as aluminum oxide or silicon carbide, and the matrix is a pure metal or alloy such as aluminum. The particle phase and the matrix metal phase each retains its separate physical and chemical identity in the composite material, and each phase contributes to the properties of the final composite material.

Several techniques are available to make useful articles of such materials. In one approach, the metallic matrix material is melted and wet to the particles, either by mixing or infiltration. The wetted mixture, in the form of a slurry of the wetted ceramic particles in a molten matrix, is then cast directly into molds in the case of the mixing approach, or diluted and then cast into molds in the case of the infiltration approach.

For some applications, the metal-matrix composite material is cast into foundry ingots at one location and shipped to the facility of a foundry user. The foundry user remelts the matrix portion of the foundry ingots, forming a remelted slurry, by heating the ingots to a temperature above the melting point of the matrix material, and then casts the remelted slurry into molds that define the shape of the final article. During the remelting operation, the remelted composite material sometimes is held at elevated temperature for several hours before casting, due to the logistics of the casting operation.

For some foundry casting operations, the remelted metal-matrix composite material must be reheated in a furnace to temperatures well above the melting point of the metal matrix. If this temperature is sufficiently high that the ceramic reinforcement chemically reacts with the matrix material to a significant degree, the resulting reaction product generally increases the viscosity of the slurry. The slurry of increased viscosity is more difficult to cast than it is prior to the chemical reaction, impairing the ability to cast many articles. Additionally, the reaction product cast into the final product may adversely affect its properties.

Several solutions to this problem are known. In one, the surfaces of the particles are coated or treated in-situ to reduce their reactivity. In another, specific matrix alloys having reduced reactivity are selected. In yet another, the remelt temperature is limited so as to reduce the extent of chemical reaction. These various approaches are workable in some circumstances, but not in others due to technical or cost issues.

There is a need for an improved approach to the remelt processing of castable metal-matrix composite materials. The present invention fulfills this need, and further provides related advantages.

SUMMARY OF THE INVENTION

The present invention provides a technique for remelting metal-matrix composite materials in a rapid fashion so as to limit the extent of the chemical reaction that occurs between the matrix and the particles at the elevated temperature. (The terms "melt" and "remelt", as used herein in reference to a composite material or to granules, means that the metal matrix phase is melted or remelted, but that the reinforcement particles remain solid. The result of melting or remelting is a slurry of the solid reinforcement particles in the molten matrix material.) A remelt charge may be quickly heated to a high temperature and then immediately cast, so that there is little opportunity for chemical degradation to occur. The remelting approach is efficient and economical in that it uses less power than required for conventional remelting techniques, and it allows the remelting to be accomplished in air rather than requiring a vacuum or a protective atmosphere. The remelting approach may be used for large or small volumes of remelted material, making it much more suitable than prior approaches for use by small foundry operations. The remelting operation avoids the entrapment of gas within the remelted mass.

In accordance with the invention, a method for preparing a composite material comprises the steps of furnishing a plurality of granules, each granule comprising a composite material of ceramic particles in a metal matrix, furnishing an induction heater having an induction coil, placing the plurality of the granules into the induction coil, and powering the induction heater to melt the metal matrix portion of the granules to form a molten mixture.

The present approach utilizes granules of the composite material, rather than ingots or powders, in the remelting operation. These granules are initially formed by any operable processing, such as melting and subsequent granule formation, or infiltration, dilution, and subsequent granule formation. The granules may be made of any operable material, such as, for example, aluminum oxide or silicon carbide particles in an aluminum metal matrix. The granules have a particle size with a smallest dimension of from about 1 to about 10 millimeters, and desirably are of smoothly spherical, ovoid, or flattened spherical shape.

The granules are placed into an induction heating coil, induction heated to remelt the metal matrix phase, and immediately cast into molds or otherwise used. High power levels may be introduced into the granules, so that heating is rapid. Individual charges of material may be prepared for each casting event, with the result that there is not a long holding period at elevated temperature. Consequently, the remelted granules may be heated to casting temperatures greater than ordinarily possible with conventional furnace-melting procedures, without producing unacceptably large quantities of chemical reaction products within the composite material. The greater remelt temperatures permit casting from higher temperatures than possible with the conventional approach. The rapid heating and short exposure time at elevated temperature also limits the extent of oxide formation at the surface of the composite material, allowing remelting in air rather than a controlled atmosphere or vacuum.

Induction melting may be scaled over a wide range from relatively small to relatively large volumes of material, permitting this approach to be used by a wide range of users without the need for investing in expensive melting furnaces, special atmospheric control equipment, and hot-metal-handling equipment, other than casting molds. The remelted composite material may be prepared in an on-demand manner, to meet logistical requirements of the casting operation.

It is usually desirable to avoid the introduction of gas and gas bubbles into molten composite materials. Any gas in dissolved form tends to prevent wetting of the molten matrix to the particles, and any gas in bubble form may be retained when the metal solidifies and may lead to internal weakness. Even though there is a substantial volume of open space between granules prior to induction melting, the melted material is remarkably free of internal gas and porosity. The final cast product is therefore quite sound, and the particles are well wetted by the metal matrix material. As known to those skilled in the art of metal-matrix composite materials, gas entrapment is a significant problem when pieces of metal-matrix composite material are melted by other techniques, such as a resistance heating furnace. That gas entrapment is avoided when melting granules is accomplished by induction heating is a surprising and unexpected advantage of the present invention.

The present induction melting approach allows the introduction and mixing of granules of different types, to achieving a controlled alloying during the melting operation. That is, the granules melted may be all of the same type of composite material, different types of composite materials, or some of composite material and some of non-composite material. This alloying capability provides important advantages for the small remelting facility, which can maintain a stock of several different types of granules and then custom tailor alloys using mixtures of the stock on hand on a job-by-job or part-by-part basis.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 3A and 3B are schematic views of an induction heating and casting apparatus, wherein FIG. 3A is a side elevational view and FIG. 3B is a front elevational view;

DETAILED DESCRIPTION OF THE INVENTION

Figure 1:
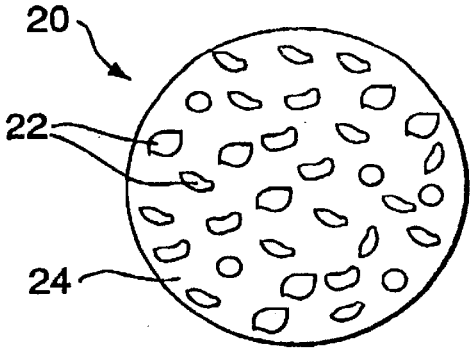
FIG. 1 is a schematic enlarged sectional view of a granule of a metal-matrix composite material.

The starting material for the present approach is granules of a metal-matrix composite material, an example of which is shown in FIG. 1. Each granule 20 includes reinforcement particles 22 embedded in a metallic matrix 24. The granule 20 may be equiaxed or elongated, and of a regular or irregular shape. The granules 20 preferably have a smallest dimension of from about 1 to about 10 millimeters. Thus, the granules are larger than typical powders and smaller than ingots. If the granules are smaller than about 1 millimeter in minimum dimension, their surface area is so large that excessive oxygen is introduced into the melt from the granules. The smaller granules also do not flow and feed well in the types of melting apparatus to be discussed subsequently. If the granule size is greater than about 10 millimeters, the ability to completely fill a crucible from a hopper or other source is hindered. Additionally, during melting the forces exerted on the larger granules becomes so great that they tend to be ejected from the melt.

The reinforcement particles 22 are preferably formed of ceramic material, such as, for example, oxides such as aluminum oxide or spinel, carbides such as silicon carbide, or graphite. The reinforcement particles are smaller than the granules, and are typically from about 1 to about 50 micrometers in size in their smallest dimension, although smaller and larger reinforcement particles are operable. The reinforcement particles may be equiaxed or elongated, and of a regular or irregular shape.

The matrix metal 24 may be any operable material. Aluminum is preferred. (When a specific metal such as "aluminum" is discussed herein, the term includes both the pure metal and its alloys, unless otherwise specified.)

In many cases, the material of the reinforcement particles 22 is chemically reactive with the matrix metal 24 at temperatures above the melting point of the matrix metal. The chemical reaction product formed at the surfaces of the particles increases the viscosity of the molten slurry, and also may adversely affect the mechanical properties of the final cast product. The extent of the chemical reaction is a function of the temperature and time of contact between the particles and the matrix.

Figure 2:
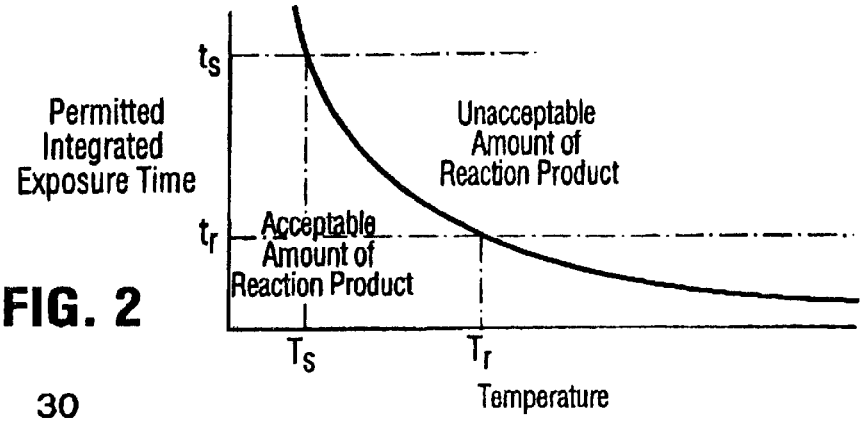
FIG. 2 is a schematic graph of the permitted integrated effective exposure time before an unacceptable amount of reaction product is formed, as a function of temperature.

FIG. 2 is a schematic graph of the integrated effective time of exposure permitted before an unacceptable amount of reaction product is formed, as a function of the temperature of exposure. The specific values of times and temperatures vary according to the materials used in the reinforcement particles and the metal matrix, as well as the nature of the casting process and the final application, but the principles are generally applicable. In regions above and to the right of the curve, an unacceptable amount of reaction product is formed. In regions below and to the left of the curve, reaction product may form, but the amount of reaction product is sufficiently small that it does not have too great an adverse effect on the properties of the final product. If a slow-reheating process, such as furnace-heating, is used which results in an integrated effective time $t_s$ at elevated temperature, the maximum temperature that may be used in reheating is $T_s$. (Because the degradation reactions are usually diffusion controlled and occur over a range of temperatures as the material is heated and held at temperature, an integrated effective time is used to denote an equivalent time at a fixed temperature for illustrative purposes.) If, on the other hand, a rapid-reheating process, such as the induction melting approach described herein, is used which results in a shorter integrated effective time $t_r$ at elevated temperature, the maximum temperature that may be used in reheating is $T_r$.

The rapid heating approach permits the composite material to be reheated and cast at higher temperatures—up to $T_r$—than possible with the slower heating approach. The use of this higher maximum temperature has important advantages in the casting operation. Most importantly, the fluidity of the mixture of molten metal and particles increases with increasing casting temperature, permitting the casting of more complex shapes at the higher casting temperatures because the composite material can flow into smaller, more complex regions of the mold than possible at lower casting temperatures.

Induction heating provides a technique for achieving rapid heating of a mass of material placed within an induction coil. However, the inventors have discovered that induction heating has drawbacks when the workpiece within the coil is a monolithic mass such as an ingot. Large electromagnetic forces are generated in the monolithic workpiece when the induction power in the induction coil is high, to achieve rapid heating. These large electromagnetic forces tend to eject the monolithic workpiece from the induction coil. At high power input, excessive splashing and air entrapment occur as the ingot begins to melt and this continues until the ingot becomes fully molten. However, if granules are used instead of a monolithic workpiece, the electromagnetic forces on each granule are relatively small and do not serve to eject the granules. Surprisingly, when granules are used, the splashing and air entrapment are greatly reduced as the material begins to melt.

The electrical efficiency achieved in induction heating is greater for small particles than for monolithic ingots. Studies performed by the inventors on the heating of ingots and granules of composite material demonstrated that the power to heat the same mass of material to a temperature above the melting point was about 28 percent less for the granules than for the ingot. The greater electrical efficiency allows more rapid heating of the plurality of granules than possible with a monolithic ingot of equivalent mass. As a result, the time required to reach the casting temperature is shorter, allowing higher values of $T_r$.

Figure 3A:
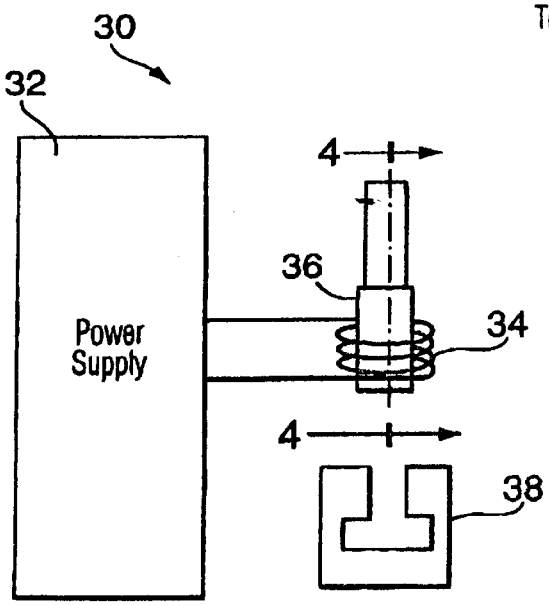
Figure 3B:
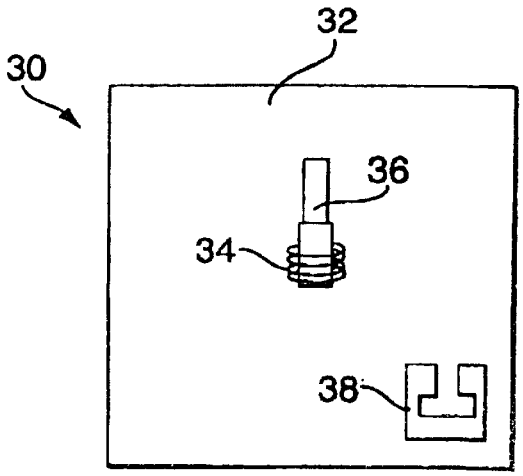

FIGS. 3A and 3B depict an induction heating and casting apparatus 30 operable with the present invention. An induction power supply 32 excites an alternating current in an induction coil 34. Any operable power supply 32 and induction coil 34 may be used. The induction power supply 32 is preferably a medium frequency induction power supply which typically operates at a frequency of from a few hundred Hertz to about 6000 Hertz, with an output power delivered to the induction coil 34 of from about 25 kilowatts to about 500 kilowatts, although these values are provided by way of example and not of limitation. Induction power supplies in a wide range of frequencies and power levels are available commercially.

The induction coil 34 is typically formed of hollow copper tubing through which a flow of cooling water is passed. The coil form of the induction coil 34 may be of any operable shape, but is typically a cylindrical spiral.

A melting vessel 36 is positioned within the induction coil 34, and the granules of the composite material are loaded into the melting vessel 36. After melting is complete, the melted composite material is typically cast (poured) into a mold 38, whose interior defines the shape of the desired article. The casting may be accomplished by rotating the induction coil 34 and the melting vessel 36 together, or by removing the melting vessel 36 from the induction coil 34 and pouring the contents.

Figure 4:
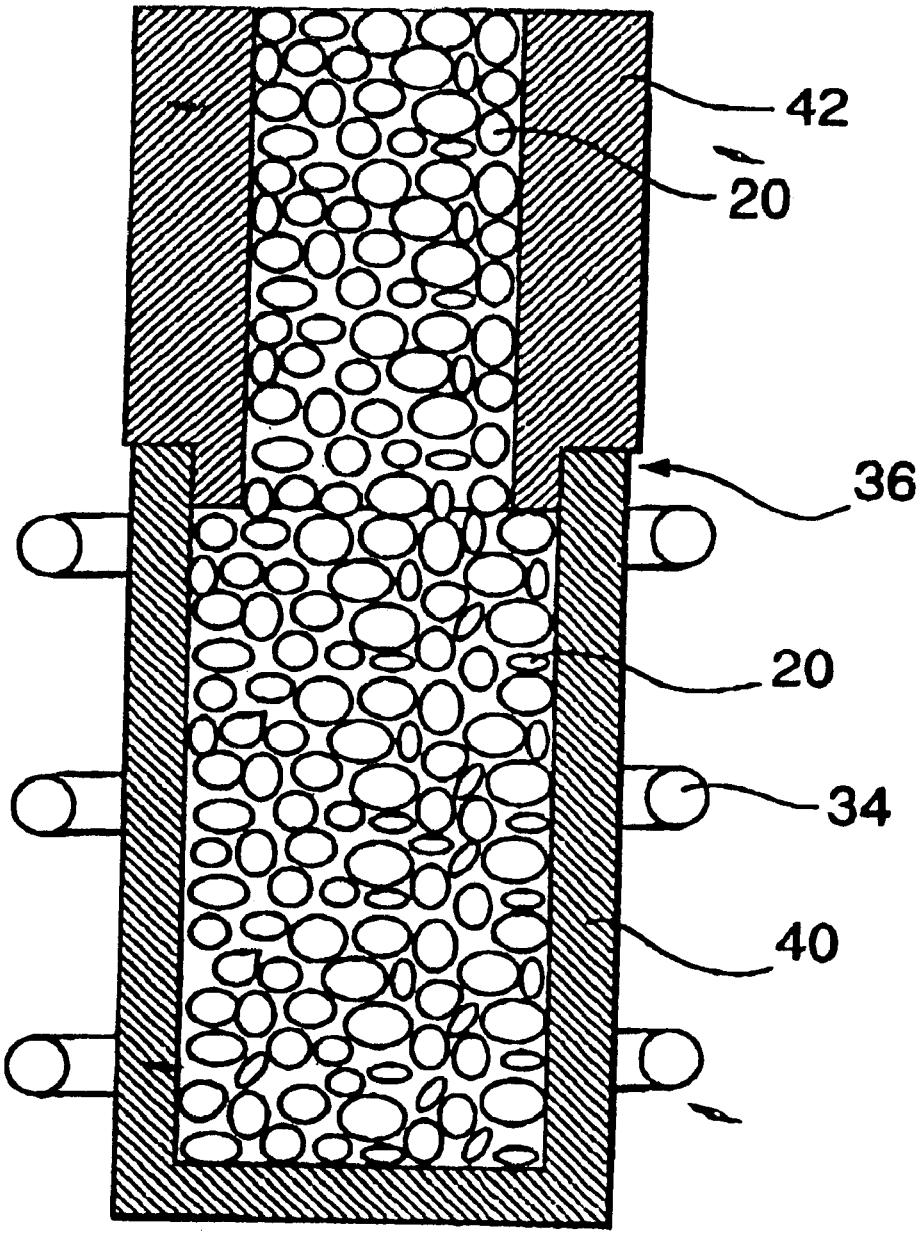
FIG. 4 is a schematic sectional view of a detail of the apparatus of FIG. 3, taken along line 4—4 of FIG. 3A.

FIG. 4 is a sectional view that illustrates the preferred form of the melting vessel 36 in greater detail. The melting vessel 36 includes a lower crucible 40 and an upper hollow feed sleeve 42 mounted to the top of the crucible 40 and generally coaxial with the crucible 40, so that solid material in the feed sleeve 42 falls into the crucible 40 as the charge in the crucible 40 becomes molten.

The crucible 40 fits axially within the induction coil 34. The crucible 40 is made of a non-suspecting material which does not electromagnetically couple with the high frequency field of the induction coil 34 and which does not itself chemically react with the components of the composite material granules, in the times and at the temperatures associated with the remelting operation. The crucible 40 is preferably a ceramic material such as aluminum oxide, clay-bonded silicon carbide, or an insulating refractory such as Pyrotek ISO-400, so that the composite material of the granules contained within the crucible may be heated directly and rapidly by the high frequency induction field. The feed sleeve 42, which does not contact the molten composite material, is preferably made of a non-suscepting ceramic material with sufficient heat resistance to resist any incidental heating. Most preferably, the feed sleeve 42 is made of a lightweight fiber based refractory, for example a calcium silicate or calcium aluminum silicate. A suitable material is Pyrotek ISO-400. The sleeve can also be provided as an extension of the crucible, and not as a separate piece.

As illustrated in FIG. 4, granules 20 are placed into the crucible 40 and the feed sleeve 42. The bed of granules 20 occupying the crucible 40 and feed sleeve 42 will typically have from about 40 to about 50 percent by volume of voids. If only the crucible 40 were filled with granules, after melting the crucible would only be about 50 to 60 percent full of metal. In the present approach, the additional granules in the feed sleeve 42 fall downwardly into the crucible 40 as the granules in the crucible 40 are melted, resulting in a full charge within the crucible 40 after melting. Surprisingly, the granules in the feed sleeve do not bridge over the feed sleeve and prevent downward falling and filling of the crucible by the overlying granules, as might be expected. Fine powders in sizes below about 1 millimeter would tend to bridge over, preventing the filling of the crucible 40 from the feed sleeve 42.

Figure 5:
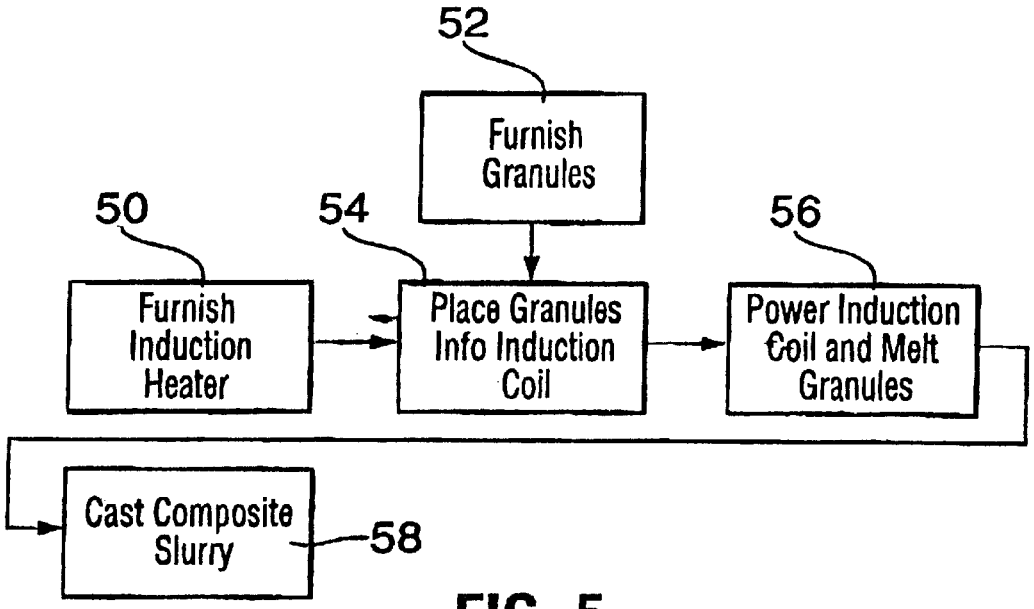
FIG. 5 is a block flow diagram of a preferred approach for practicing the invention.

FIG. 5 depicts the preferred method for practicing the invention. An induction heater apparatus is furnished, numeral 50. The induction heater apparatus is preferably that discussed above in relation to the apparatus 30. Granules are furnished, numeral 52, preferably the granules 20 discussed previously. The granules may be all of the same type of composite material, two or more different types of composite materials, or different types of composite materials and non-composite materials. The granules are placed into the induction coil, typically within the melting vessel 36. The induction power supply and thence the induction coil are powered to heat and melt the composite material of the granules, numeral 56. No special protective atmosphere or vacuum is ordinarily required for the granules and the melt, and the rapid heating and melting may be conducted with the granules and the melt exposed to the air. This is an important advantage for small-scale operations, where special atmospheric controls significantly increase the cost of the apparatus. However, a protective inert atmosphere or a vacuum may be used, if desired for particular applications. The molten slurry of solid ceramic reinforcement particles within the molten metal matrix is thereafter cast into the mold 38, numeral 58.

One feature of the present approach is that a higher power level may be used to heat and melt the granules than possible with conventional heating techniques. The inventors have found that the power to the induction coil may exceed about 25 kilowatts per liter of volume within the heated portion of the crucible (not per liter of granules), or even 50 kilowatts per liter, resulting in rapid heating and melting of the composite material in the granules. Heating in a furnace and heating of a monolithic mass of composite material in the induction coil cannot reach this rate of power input. At a power input rate of 25 kilowatts per liter, a monolithic mass will experience uneven melting, and the electromagnetic forces developed will tend to eject the mass from the crucible both as a solid and as a partly melted mass. When granules are fed from above as in the present case, they not only melt efficiently, but the feeding of granules tends to damp out any splashing or agitation of the melting material, and there is no tendency for ejection of either solid granules or the melted material.

Figure 6:
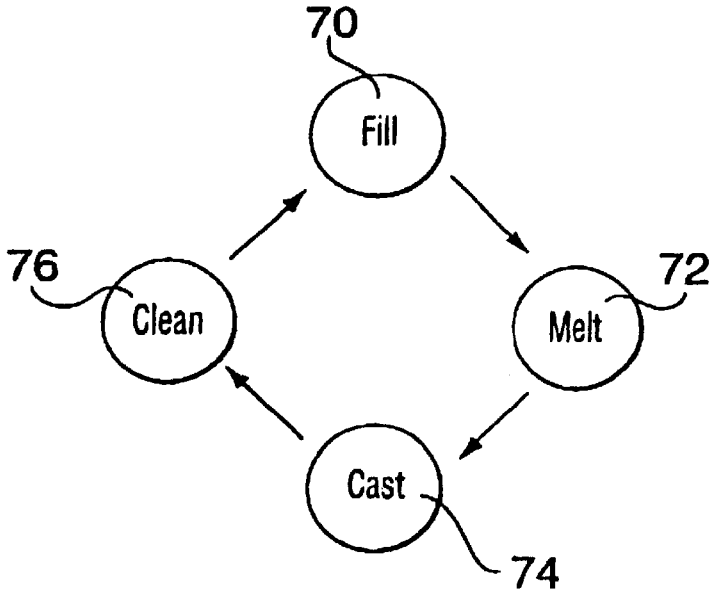
FIG. 6 is a schematic diagram of a carousel approach for casting a series of articles according to the present invention.

The approach of the invention is particularly suitable for use in a semi-continuous batch operation for the production of articles. Such a process in the form of a "carousel" apparatus is illustrated schematically in FIG. 6, which utilizes the articles of apparatus discussed earlier. A succession of melting vessels is moved semi-continuously through a series of stations. At a first station 70, the melting vessel 36 is filled with granules. The melting vessel 36 is thereafter moved to a second station 72, where it is placed into an induction coil 34 and heated to melt the matrix material of the granules to the desired casting temperature. The melting vessel 36 is thereafter removed from the induction coil and moved to a third station 74, where the molten composite material is poured into the mold 38 or another casting device such as a metal injection molding apparatus or die casting apparatus. The now-empty melting vessel 36 is thereafter moved to a fourth station 76, where it inspected and cleaned. It is thereafter moved to the first station 70 to repeat the cycle.

This semi-continuous batch operation, using relatively small charges of composite material granules in the melting vessel, has important technical and commercial advantages over a more-conventional process in which a single large batch of composite material is melted, although the present invention may be used for single large batches of composite material made from granules. In the semi-continuous batch operation, the composite material is molten for a relatively short time, on the order of at most 1–5 minutes, rather than being held in the molten state for as much as many hours in conventional processing using a melting furnace. There is consequently less time for chemical interaction between the particles and the molten matrix, and the resulting cast product is of higher quality. The semi-continuous batch approach also is more convenient for small production operations, as it may be started and stopped more quickly than can a large-batch operation, and it is possible to cast a relatively small number of articles in an efficient manner.

To demonstrate the operability of the process and its suitability for the semi-continuous batch approach, a small batch of 6⅔ kilograms of granules of A359 aluminum alloy containing 20 percent by volume of SiC particles was prepared. (A359 alloy has a nominal composition, in weight percent, of 8.5–9.5 percent silicon, 0.45–0.55 percent magnesium, 0.2 percent maximum copper, 0.2 percent maximum iron, 0.2 percent maximum titanium, less than 0.03 percent of any other element with less than 0.1 percent total of other elements, balance aluminum.) The granules were placed into a melting vessel made of a low-density refractory fiber (Pyrotek ISO-400), which was in turn placed into an induction coil. The induction coil was powered at 125 kilowatts for 90 seconds, and the power was reduced to 83 kilowatts for a final 40 seconds. At this point, the entire batch had melted to a temperature of 700° C., which is suitable for many casting operations. The net energy consumption was 0.61 kilowatt-hours per kilogram. With melting being accomplished in only 130 seconds, the process is fully suitable for use in the semi-continuous batch approach of the carousel type discussed above.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing a composite material, comprising the steps of:

furnishing a plurality of granules, each granule comprising a composite material of ceramic particles distributed in a metal matrix furnishing an induction heater having an induction coil;

furnishing a melting vessel having at least a portion thereof disposed within the induction coil;

placing the plurality of the granules into that portion of an interior of the melting vessel which is disposed within the induction coil; and powering the induction heater to melt the metal matrix portion of the granules to form a molten mixture; and transferring the molten mixture into a mold.

2. The method of claim 1, wherein the step of furnishing a plurality of granules includes the step of furnishing a plurality of granules, each granule comprising ceramic particles distributed in an aluminum-alloy matrix.

3. The method of claim 1, wherein the step of furnishing a plurality of granules includes the step of furnishing a plurality of granules, each granule comprising ceramic particles selected from the group consisting of aluminum oxide, spinel, and silicon carbide distributed in an aluminum-alloy matrix.

4. The method of claim 1, wherein the step of furnishing a plurality of granules includes the step of furnishing a plurality of granules, wherein the ceramic particles are chemically reactive with the metal matrix at an elevated temperature greater than the melting point of the metal matrix.

5. The method of claim 1, wherein the step of furnishing a plurality of granules includes the step of furnishing granules having a smallest dimension of from about 1 to about 10 millimeters.

6. The method of claim 1, wherein the step of furnishing a plurality of granules includes the step of furnishing smooth granules having a shape selected from the group consisting of spherical, ovoid, and flattened spherical particles.

7. The method of claim 1, wherein the step of placing a plurality of the granules includes the step of furnishing a melting vessel including a crucible having an outer diameter and length sized to fit within the induction coil, and a sleeve in communication with an interior of the crucible and extending upwardly out of the induction coil; and filling the crucible and at least a portion of the sleeve with granules.

8. The method of claim 1, wherein the step of powering includes the step of furnishing power to the induction coil of greater than about 25 kilowatts per liter of volume within a portion of the crucible lying within the induction coil.

9. The method of claim 1, wherein the step of powering includes the step of exposing the granules and the molten mixture to the air during the step of powering.

10. The method of claim 1, wherein the melting vessel comprises a crucible that is disposed within the induction coil, and a feed sleeve positioned to feed granules downwardly into the crucible concurrently with the step of powering the induction heater.

11. The method of claim 1, including an additional step, performed concurrently with the step of powering the induction heater, of adding additional granules to that portion of the melting vessel disposed within the induction coil.

12. The method of claim 1, including an additional step, performed concurrently with the step of powering the induction heater, of allowing additional granules to fall downwardly into that portion of the melting vessel disposed within the induction coil.

13. The method of claim 1, wherein the step of furnishing a plurality of granules includes the step of furnishing a plurality of granules, each granule comprising ceramic particles distributed in a metal matrix.

14. The method of claim 1, wherein the step of furnishing a plurality of granules includes the step of furnishing a plurality of granules comprising composite granules of ceramic particles in a metal matrix, and non-composite granules.

15. A method for preparing a composite material, comprising the steps of:

furnishing a plurality of granules, each granule comprising a composite material of ceramic particles distributed in a metal matrix;

furnishing a multistation, semi-continuous batch facility, the facility including
a filling station,
a melting station having an induction heater, and
a casting station having a casting mold;

furnishing a melting vessel;

filling the melting vessel with granules at the filling station; thereafter moving the melting vessel to the melting station and melting the granules in the melting vessel; and thereafter moving the melting vessel to the casting station and casting the melted granules into the casting mold.

16. The method of claim 15, including an additional step, after the step of moving the melting vessel to the casting station and casting the melted granules into the casting mold, of moving the melting vessel to the filling station and repeating the step of filling.

17. The method of claim 15, including an additional step, after the step of moving the melting vessel to the casting station and casting the melted granules into the casting mold, of inspecting and cleaning the melting vessel.

18. The method of claim 15, wherein the step of furnishing a plurality of granules includes the step of furnishing a plurality of granules, each granule comprising ceramic particles distributed in an aluminum-alloy matrix.

19. A method for preparing a composite material, comprising the steps of:

furnishing a plurality of granules, each granule comprising ceramic particles selected from the group consisting of aluminum oxide, spinel, and silicon carbide distributed in an aluminum-alloy matrix.

furnishing an induction heater having an induction coil;

furnishing a melting vessel having at least a portion thereof disposed within the induction coil;

placing the plurality of the granules into that portion of an interior of the melting vessel which is disposed within the induction coil; and powering the induction heater to melt the metal matrix portion of the granules to form a molten mixture.

20. The method of claim 19, including an additional step, after the step of powering, of casting the molten mixture into a mold.

* * * * *